US006124668A

United States Patent [19]

Shoda

[11] Patent Number: 6,124,668

[45] Date of Patent: Sep. 26, 2000

[54] COLOR CATHODE RAY TUBE

[75] Inventor: Akira Shoda, Gumma-ken, Japan

[73] Assignee: Kabushiki Kaisha Toshiba, Kawasaki, Japan

[21] Appl. No.: 09/101,193

[22] PCT Filed: Oct. 31, 1997

[86] PCT No.: PCT/JP97/03994

§ 371 Date: Jul. 2, 1998

§ 102(e) Date: Jul. 2, 1998

[87] PCT Pub. No.: WO98/20514

PCT Pub. Date: May 14, 1998

[30] Foreign Application Priority Data

Nov. 5, 1996 [JP] Japan ..... 8-292578

[51] Int. Cl.[7] ..... H01J 29/80

[52] U.S. Cl. ..... 313/403

[58] Field of Search ..... 313/402, 403, 313/407, 408

[56] References Cited

U.S. PATENT DOCUMENTS 5,616,985 4/1997 Hosotani ..... 313/403

FOREIGN PATENT DOCUMENTS 57-050336 10/1982 Japan .

6-310049 11/1994 Japan .

*Primary Examiner*—Ashok Patel

*Attorney, Agent, or Firm*—Pillsbury Madison & Sutro LLP

[57] ABSTRACT

A shadow mask disposed to face a phosphor screen of a cathode ray tube includes a substantially rectangular effective surface on which a number of substantially rectangular apertures are formed. The effective surface has horizontal and vertical axes which perpendicularly cross in the center thereof and diagonal axes passing through the center. The apertures are arranged to form a plurality of vertical rows of apertures extending in the direction of the vertical axis. Each of the vertical rows of apertures includes a plurality of apertures arranged in the direction of the vertical axis with a bridge portion being interposed between two adjacent apertures, and those vertical rows of apertures are arranged in the direction of the horizontal axis at a predetermined pitch. The width W of the apertures in the direction of the horizontal axis is formed so as to gradually increase from that of the aperture located at the center of the effective surface to that of the apertures located at the peripheries of the effective surface in the direction of the horizontal axis. The width of each of corner apertures located in the vicinity of the ends of the diagonal axes is larger than the width of the aperture located on the horizontal axis in the same vertical row of apertures to which the corner aperture belongs.

7 Claims, 3 Drawing Sheets

COLOR CATHODE RAY TUBE

This application is the national phase of international application PCT/JP97/03994 filed on Oct. 31, 1997 which was designated the U.S.

TECHNICAL FIELD

The present invention relates to a color cathode ray tube and, more particularly, to a color cathode ray tube including a shadow mask having a number of rectangular apertures as apertures for transmitting electron beams.

BACKGROUND ART

In general, a color cathode ray tube includes an envelope having a substantially rectangular panel, a phosphor screen formed of phosphor layers, emitting three colors, formed on the inner surface of an effective region of the panel, and a substantially rectangular shadow mask disposed inside the phosphor screen in a face-to-face relationship. A multiplicity of apertures serving as electron beam passage apertures are formed in an effective surface of the shadow mask in a predetermined arrangement. Three electron beams emitted from an electron gun disposed in a neck of the envelope impinge upon predetermined phosphor layers according to selection performed by the shadow mask, thereby displaying a color image.

In such a color cathode ray tube, each of the apertures in the shadow mask is formed in a substantially rectangular configuration. A plurality of rows of apertures are arranged to extend vertically and arranged in the horizontal direction at predetermined spacing. Each of the aperture rows includes a plurality of apertures which are arranged in the vertical direction with a bridge portion being interposed between two adjacent apertures. Each of the phosphor layers in three colors on the phosphor screen is formed like elongate stripes extending vertically, relative to the shadow mask.

With the shadow mask of this type has been provided in which the width W of the apertures in the horizontal direction is gradually increased or kept constant from that of the aperture located at the center of the effective surface of the shadow mask to that of apertures located in the horizontal peripheries of the effective surface and in which the apertures in the same row of apertures extending vertically have the same width W. Such an aperture width W in the horizontal direction is expressed by:

$$D=C+K1\cdot X^2$$

where C represents the horizontal width of the aperture at the center of the effective surface; (X, Y) represents the coordinates of the aperture in an arbitrary position of the effective surface relative to the horizontal axis (x-axis) and the vertical axis (y-axis) which perpendicularly cross each other on the center of the effective surface; and K1 is a coefficient.

In general, phosphor layers in three colors in the form of stripes that constitute a phosphor screen are formed by a photographic printing process in which the shadow mask to be incorporated in the color cathode ray tube is used as an optical mask. Specifically, the phosphor screen is irradiated with light from a light source of an exposing device through the shadow mask to print the phosphor layers in three colors on the phosphor screen. However, when phosphor layers in three colors are printed by applying the shadow mask as described above to a flat tube wherein the effective region of the panel is nearly planar and a deflection angle is about 110°, a phenomenon occurs wherein phosphor layers become undesirably narrow in the vicinity of the ends of diagonal axes of the panel effective region where illuminance of the light from the exposing device is lowest. Further, depending on the relationship between the position of the light source, the curvature of the shadow mask and the curvature of the panel, a phenomenon may be encountered wherein the phosphor layers thus formed meander and a corrective action to this makes the phosphor layers narrower.

When phosphor layers in the vicinity of the end portions of the diagonal axes are narrowed as described above, brightness is lowered in the vicinity of the corners of the display screen to give dark appearance, which results in a problem in that the so-called color purity is reduced.

DISCLOSURE OF INVENTION

The present invention has been conceived to solve the above-mentioned problems, and its object is to provide a color cathode ray tube having excellent color purity by eliminating the phenomenon wherein phosphor layers in the form of stripes are narrowed.

In order to achieve the object, a color cathode ray tube according to the invention comprises: an envelope including a face panel having a phosphor screen formed on an inner surface thereof; a shadow mask disposed in the envelope to face the phosphor screen; and an electron gun disposed in a neck of the envelope for emitting electron beams to the phosphor screen through the shadow mask.

The shadow mask includes a substantially rectangular effective surface and a number of substantially rectangular apertures formed in the effective surface for transmitting the electron beams. The effective surface has a horizontal axis and a vertical axis which perpendicularly cross on the center of the effective surface, and diagonal axes which pass through the center.

The apertures are arranged to constitute a plurality of vertical rows which extend vertically and are arranged at a predetermined pitch in the direction of the horizontal axis. Each of the vertical rows of apertures includes a plurality of such apertures arranged in the direction of the vertical axis with a bridge portion being interposed between two adjacent apertures. The width of the apertures in the direction of the horizontal axis is formed so as to gradually increase from that of the aperture at the center of the effective surface to that of the apertures located at the peripheries of the effective surface in the direction of the horizontal axis thereof. The width of each of corner apertures located in the vicinity of the ends of the diagonal axes is larger than the width of the aperture located on the horizontal axis in the vertical row of apertures to which the corner aperture belongs.

In a color cathode ray tube according to the invention, the apertures are formed in a size which is expressed by:

$$W=C+K1\cdot X^2+K2\cdot X^A\cdot Y^B$$

where W represents the width of the aperture in an arbitrary position on the effective surface in the direction of the horizontal axis; C represents the width of the aperture in the center of the effective surface; X and Y represent coordinates of the aperture at the arbitrary position relative to the horizontal axis and the vertical axis; and K1 and K2 are coefficients, and which satisfies $A\geqq 4$ and $B\geqq 3$.

In a color cathode ray tube according to the invention, the apertures are formed in a size which is satisfies:

$$W=C+K1\cdot X^2+K2\cdot Y^B$$

where W represents the width of the aperture in an arbitrary position on the effective surface in the direction of the horizontal axis; C represents the width of the aperture in the center of the effective surface; X and Y represent coordinates of the aperture at the arbitrary position relative to the horizontal axis and the vertical axis; and K1 and K2 are coefficients.

Further, in a color cathode ray tube according to the invention, the apertures are formed with a size which is satisfies:

$$W=C+K1\cdot X^2+K2\cdot X^4$$

where W represents the width of the aperture in an arbitrary position on the effective surface in the direction of the horizontal axis; C represents the width of the aperture in the center of the effective surface; X and Y represent coordinates of the aperture at the arbitrary position relative to the horizontal axis and the vertical axis; and K1 and K2 are coefficients.

BRIEF DESCRIPTION OF DRAWINGS

FIGS. 1 through 5 show a color cathode ray tube according to an embodiment of the invention in which:

FIG. 1 is a longitudinal sectional view of the color cathode ray tube;

FIG. 2 is an enlarged plan view of a part of a phosphor screen provided on an inner surface of a face panel of the color cathode ray tube;

FIG. 3 is a plan view of a shadow mask of the color cathode ray tube;

FIG. 4 is an enlarged plane view of a corner portion of the shadow mask;

FIG. 5 is a graph showing changes in the width of apertures arranged on a diagonal axis of the shadow mask depending on the distance from the center of an effective surface in the direction of a horizontal axis;

BEST MODE OF CARRYING OUT THE INVENTION

A color cathode ray tube according to an embodiment of the invention will now be described in detail with reference to the drawings.

Figure 1:
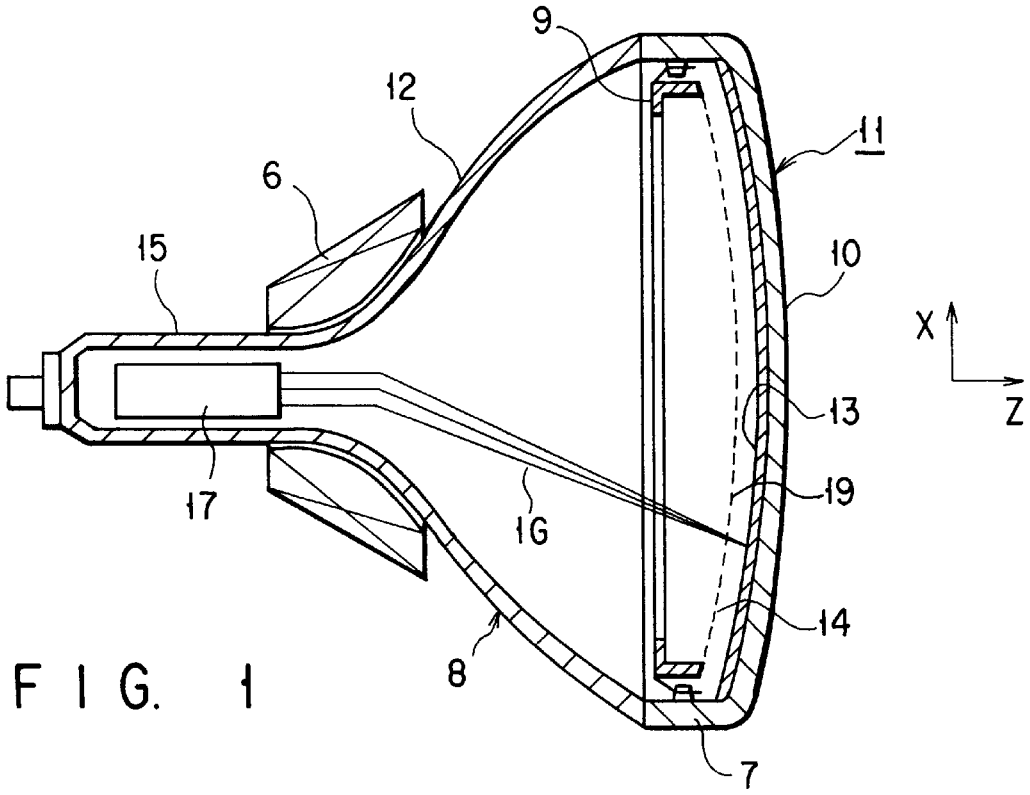

Referring to FIG. 1, the color cathode ray tube includes a vacuum envelope 8 having a face panel 11 and a funnel 12. The face panel 11 includes a substantially rectangular effective portion 10 which is constituted by a curved surface, and a skirt portion 7 erected on the periphery of the effective portion. The funnel 12 is connected to the skirt portion 7.

Figure 2:
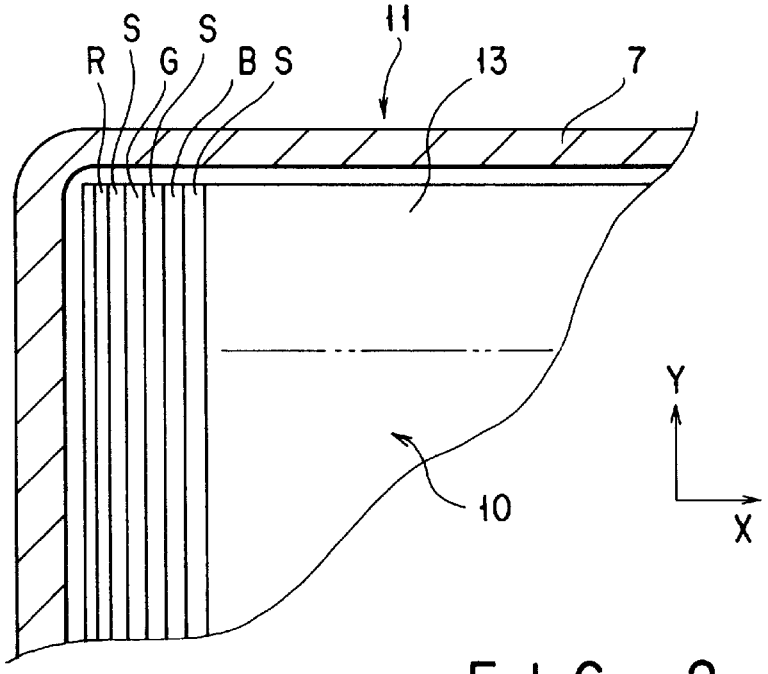

A phosphor screen 13 is formed on an inner surface of the effective portion 10 of the face panel 11. As shown in FIG. 2, the phosphor screen 13 is constituted by phosphor layers in three colors R, G, and B in the form of elongate stripes which emit blue, green and red beams of light and which extend in a vertical direction Y. Shading layers S in the form of stripes are formed between the phosphor layers.

A substantially rectangular shadow mask 14 is disposed in the vacuum envelope 8 to face the phosphor screen 13. The shadow mask 14 is mounted to a mask frame 9 at the periphery thereof and is supported by the skirt portion 7 of the face panel 11 through the mask frame.

An electron gun 17 is disposed in a neck 15 of the funnel 12 for emitting three electron beams 16 aligned in a row that travel on the same horizontal plane. Further, a deflection device 6 is fitted on the outer circumference of the funnel 12 in the vicinity of the neck 15.

The three electron beams 16 emitted from the electron gun 17 are deflected in the horizontal and vertical directions by magnetic fields generated by the deflecting device 6 so as to scan the phosphor screen 13 horizontally and vertically through the shadow mask 14, thereby displaying a color image on the phosphor screen.

Figure 3:
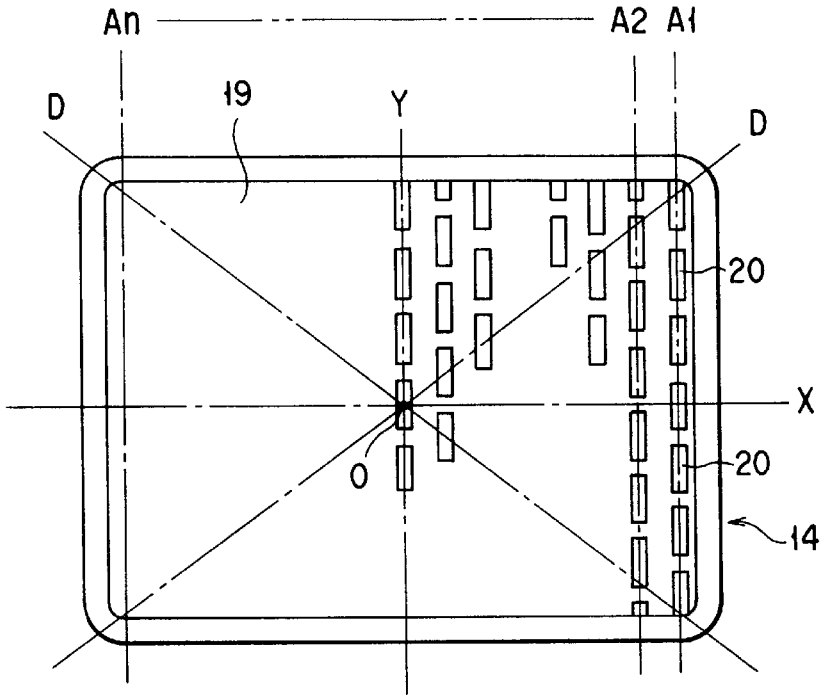
Figure 4:
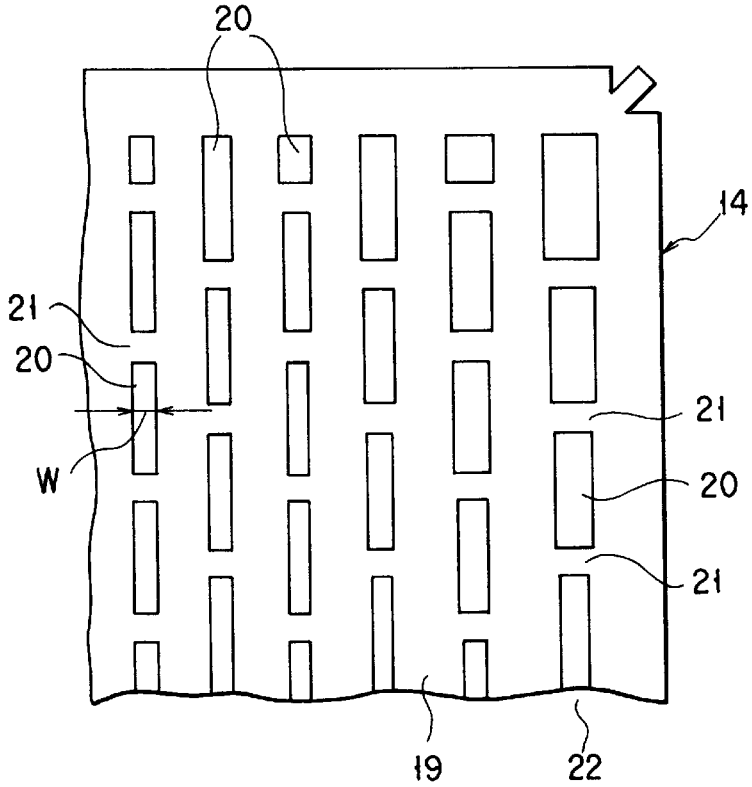

As shown in FIGS. 1, 3 and 4, the shadow mask 14 includes a substantially rectangular effective surface 19 in a face-to-face relationship with the phosphor screen 13, which is constituted by a curved surface corresponding to the effective portion 10 of the face panel 11. Further, the effective surface 19 has a center O through which a tube axis Z of the color cathode ray tube passes, a horizontal axis X and a vertical axis Y which pass through the center and which cross each other perpendicularly, and diagonal axes D which pass through the center O and extend between opposite corners of the effective surface 19.

The effective surface 19 of the shadow mask 14 is formed with a number of rectangular apertures 20 for transmitting electron beams through each of them. A plurality of the apertures 20 are arranged in a row in the vertical direction Y with a bridge portion 21 interposed between two adjacent apertures to form vertical rows of apertures A1 through An, and a plurality of such vertical rows of apertures are arranged in the horizontal direction X at a predetermined pitch.

The apertures 20 have a horizontal aperture width W which gradually increases from that of the apertures on the horizontal axis to that of the apertures at the vertical peripheries of the shadow mask 14 and gradually increase from that of the apertures on the vertical axis Y toward that of the apertures at the horizontal peripheries of the shadow mask 14.

Figure 5:
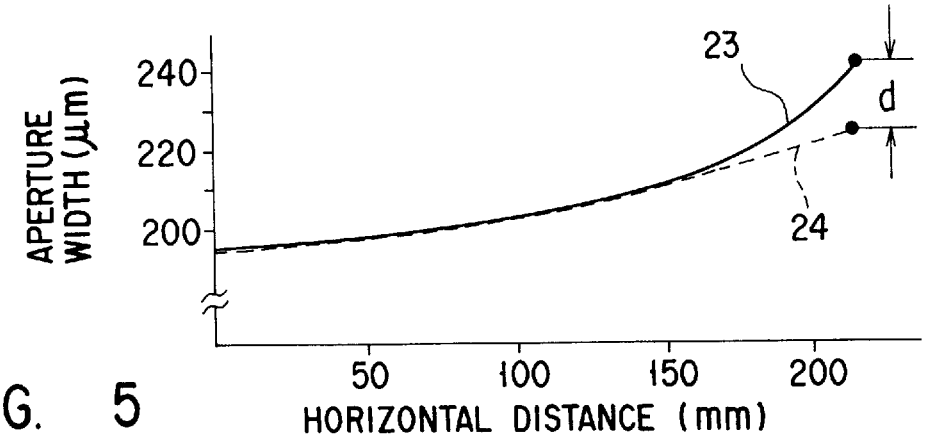

As indicated by the curve 23 in FIG. 5, the apertures 20 arranged on the diagonal axes D of the shadow mask 19 have a width W in the horizontal direction which increases with changes in the distance of the apertures from the center C of the effective surface 19 as the ends of the diagonal axes D, i.e., the corners of the effective surface become closer. In FIG. 5, the abscissa axis represents horizontal distances from the center O of the effective surface 19, and the ordinate axis represents the widths of the apertures 20. The curve 24 in a broken line represents changes in the width W of the apertures 20 arranged on the horizontal axis X.

As apparent from comparison between the curves 23 and 24, the width W of each of the corner apertures 20 located at the ends of the diagonal axes D is larger than the width W of the aperture 20 located on the horizontal axis X in the same vertical row of apertures by an amount d.

For example, let us assume that, on a shadow mask used in a color cathode ray tube in a size of 25 inches having a deflection angle of 110°, the width of an aperture 20 located in the center O of the effective surface 19 of the shadow mask is 200$\mu$m. Then, the widths W of a plurality of apertures 20 located on the diagonal axes D satisfy a relationship that the aperture in the center of the effective surface<the apertures in the middle of the diagonal axes (a conventional dimension×1.01)<the corner apertures at the outer ends of the diagonal axis (a conventional dimension×

1.05). It is desirable that the width W of the corner apertures located at the outer ends of the diagonal axes are set at 1.04 to 1.10 times the width of the aperture located at the center of the effective surface. It should be noted that the width W of those apertures is appropriately chosen depending on the size of the cathode ray tube, exposing conditions for the phosphor screen, the radii of curvature of the panel and screen and the like and may be preferably greater than 1.1 times.

The horizontal width W of the apertures on such a shadow mask is expressed by the following Equation (1)

$$W=C+K1\cdot X^2+K2\cdot X^A\cdot Y^B \quad (1)$$

$$A\geqq 4,\ B\geqq 3$$

where C represents the horizontal width of the aperture located in the center O of the effective surface 19; X and Y represent the coordinates of the aperture in an arbitrary position on the effective surface relative to the horizontal axis X and vertical axis Y that perpendicularly cross on the center O of the effective surface; and K1 and K2 are coefficients.

In Equation (1), when the width C of the aperture 20 in the center O of the effective surface is set, the coefficient K1 can be derived by substituting the horizontal coordinate value X of an arbitrary aperture and the horizontal width W that the aperture must have into Equation (1). If the coefficient K1 is determined, the coefficient K2 can be derived as follows.

The multipliers A and B are set at 4 or more and 3 or more, respectively, as described above and, particularly, are set in ranges from 6 to 9 and from 5 to 8, respectively, to increase the horizontal width W of the apertures 20 located at the end portions of the horizontal axes D.

For example, when it is desired that an aperture 20 located between a position 30 mm apart from the end of an diagonal axis D and the end of the diagonal axis has a horizontal width W which is 20 $\mu$m greater than the width of the aperture located at the center of the effective surface, the coordinate values X, Y of the aperture at the end of the diagonal axis is first obtained and is substituted into Equation (1) to obtain K1 and K2. When K1 and K2 are thus set, the horizontal widths W of the apertures 20 on the entire effective surface 19.

With the shadow mask 14 having the above-described configuration, among the apertures 20 formed on the effective surface 19, each of corner apertures 20 located in the vicinity of the ends of the diagonal axes D has a horizontal width W which is larger than the widths W of other apertures located in the same vertical row of apertures to which the corner aperture belongs. By forming phosphor layers of a phosphor screen through a photographic printing process using such a shadow mask 14 as an optical mask, it is possible to prevent the phenomenon that the phosphor layers in the form of stripes are narrowed in the vicinity of the ends of the diagonal axes of the phosphor screen, thereby providing phosphor layers having a predetermined width even in the vicinity of the ends of the diagonal axes. This makes it possible to provide a color cathode ray tube having excellent color purity.

Figure 6:
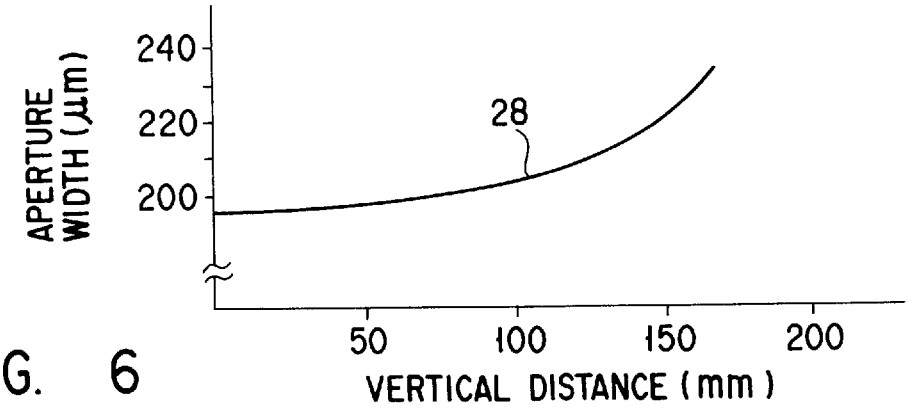
FIG. 6 is a graph showing changes in the width of apertures arranged on a vertical axis of the shadow mask depending on the distance from the center of the effective surface in the direction of the vertical axis.

Further, as indicated by the curve 26 in FIG. 6, to increase the horizontal width W of the apertures 20 located in the peripheries in the direction of the vertical axis Y of the shadow mask effective surface 19, the apertures 20 can be set at a desired size using Equation (2) shown below which is obtained by changing Equation (1). Thus, an adequate width can be achieved for the phosphor layers in the form of stripes at the peripheries of the phosphor screen in the direction of the vertical axis thereof. This makes it possible to provide a color cathode ray tube having excellent color purity.

$$W=C+K1\cdot X^2+K2\cdot Y^B \quad (2)$$

Figure 7:
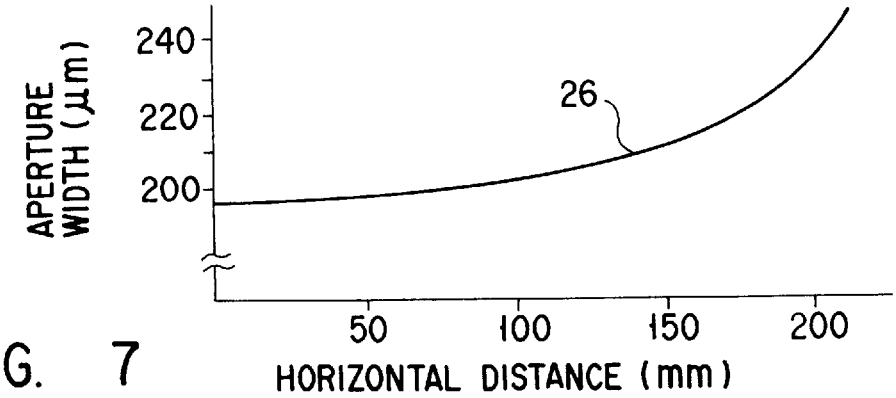
FIG. 7 is a graph showing changes in the width of apertures arranged on a horizontal axis of the shadow mask depending on the distance from the center of the effective surface in the direction of the horizontal axis.

As indicated by the curve 28 in FIG. 7, to increase the horizontal width W of the apertures 20 located in the peripheries in the direction of the horizontal axis X of the shadow mask effective surface 19, the apertures 20 can be set at a desired size using Equation (3) shown below which is obtained by changing Equation (1). Thus, a adequate width can be achieved for the phosphor layers in the form of stripes at the peripheries of the phosphor screen in the direction of the horizontal axis thereof. This makes it possible to provide a color cathode ray tube having excellent color purity.

$$W=C+K1\cdot X^2+K2\cdot X^A \quad (3)$$

In addition, by using both of Equations 2 and 3 in combination with Equation (1), the horizontal widths W of the apertures on the entire effective surface 19 can be set at optimum dimensions.

What is claimed is:

1. A color cathode ray tube comprising:

an envelope including a face panel having a phosphor screen with a number of phosphor layers in the form of stripes formed on an inner surface of the face panel;

a shadow mask disposed in the envelope to face the phosphor screen;

an electron gun disposed in a neck of the envelope for emitting electron beams toward the phosphor screen through the shadow mask;

the shadow mask including a substantially rectangular effective surface and a number of substantially rectangular apertures formed on the effective surface for transmitting the electron beams, and the effective surface having a horizontal axis and a vertical axis which perpendicularly cross at the center of the effective surface, and diagonal axes which pass through the center;

the apertures being arranged to constitute a plurality of vertical rows of apertures which extend in the direction of the vertical axis and are arranged in the direction of the horizontal axis at a predetermined pitch, each of the vertical rows of apertures including a plurality of apertures which are arranged in the direction of the vertical axis with a bridge portion being interposed between two adjacent apertures, and the width of the apertures in the direction of the horizontal axis being formed so as to gradually increase from that of the aperture located at the center of the effective surface to that of the apertures located at the peripheries of the effective surface in the direction of the horizontal axis thereof; and the width of each of corner apertures located in the vicinity of the ends of the diagonal axes being larger than the width of the aperture located on the horizontal axis in the same vertical row of apertures to which the corner aperture belongs.

2. A color cathode ray tube according to claim 1, wherein the width of the apertures in the direction of the horizontal axis is formed so as to gradually increase from that of the aperture located at the center of the effective surface to that of the apertures located at the peripheries in the direction of the vertical axis.

3. A color cathode ray tube comprising:

an envelope including a face panel having a phosphor screen with a multiplicity of phosphor layers in the form of stripes formed on an inner surface of the face panel;

a shadow mask disposed in the envelope to face the phosphor screen; and an electron gun disposed in a neck of the envelope for emitting electron beams toward the phosphor screen the shadow mask;

the shadow mask including a substantially rectangular effective surface and a number of substantially rectangular apertures formed on the effective surface for transmitting the electron beams, and the effective surface having a horizontal axis and a vertical axis which perpendicularly cross at the center of the effective surface, and diagonal axes which pass through the center;

the apertures being arranged to constitute a plurality of vertical rows of apertures which extend in the direction of the vertical axis and are arranged in the direction of the horizontal axis at a predetermined pitch, each of the vertical rows of apertures including a plurality of apertures which are arranged in the direction of the vertical axis with a bridge portion being interposed between two adjacent apertures, and the width of the apertures in the direction of the horizontal axis being formed so as to gradually increase from that of the aperture located at the center of the effective surface to that of the apertures located at the peripheries of the effective surface in the direction of the horizontal axis thereof; and the apertures being formed in a size which is expressed by:

$$W=C+K1\cdot X^2+K2\cdot X^A\cdot Y^B$$

where W represents the width of the aperture in an arbitrary position on the effective surface in the direction of the horizontal axis; C represents the width of the aperture at the center of the effective surface; X and Y represent coordinates of the aperture at the arbitrary position relative to the horizontal axis and vertical axis; and K1 and K2 are coefficients, and which satisfies $A \geqq 4$ and $B \geqq 3$.

4. A color cathode ray tube according to claim 3, wherein the width of the apertures in the direction of the horizontal axis is formed so as to gradually increase from that of the aperture located at the center of the effective surface to that of the apertures located at the peripheries in the direction of the vertical axis.

5. A color cathode ray tube comprising:

an envelope including a face panel having a phosphor screen with a number of phosphor layers in the form of stripes formed on an inner surface of the face panel;

a shadow mask disposed in the envelope to face the phosphor screen;

an electron gun disposed in a neck of the envelope for emitting electron beams toward the phosphor screen through the shadow mask;

the shadow mask including a substantially rectangular effective surface and a number of substantially rectangular apertures formed on the effective surface for transmitting the electron beams, and the effective surface having a horizontal axis and a vertical axis which perpendicularly cross at the center of the effective surface, and diagonal axes which pass through the center;

the apertures being arranged to constitute a plurality of vertical rows of apertures which extend in the direction of the vertical axis and are arranged in the direction of the horizontal axis at a predetermined pitch, each of the vertical rows of apertures including a plurality of apertures which are arranged in the direction of the vertical axis with a bridge portion being interposed between two adjacent apertures, and the width of the apertures in the direction of the horizontal axis being formed so as to gradually increase from that of the aperture located at the center of the effective surface to that of the apertures located at the peripheries of the effective surface in the direction of the horizontal axis and so as to gradually increase from that of the aperture located at the center of the effective surface to that of the apertures at the peripheries of the effective surface in the direction of the vertical axis; and the apertures being formed in a size which satisfies:

$$W=C+K1\cdot X^2+K2\cdot Y^B$$

where W represents the width of the aperture in an arbitrary position on the effective surface in the direction of the horizontal axis; C represents the width of the aperture in the center of the effective surface; X and Y represent coordinates of the aperture at the arbitrary position relative to the horizontal axis and vertical axis; and K1 and K2 are coefficients.

6. A color cathode ray tube comprising:

an envelope including a face panel having a phosphor screen with a multiplicity of phosphor layers in the form of stripes formed on an inner surface of the face panel;

a shadow mask disposed in the envelope to face the phosphor screen; and an electron gun disposed in a neck of the envelope for emitting electron beams toward the phosphor screen the shadow mask;

the shadow mask including a substantially rectangular effective surface and a number of substantially rectangular apertures formed on the effective surface for transmitting the electron beams, and the effective surface having a horizontal axis and a vertical axis which perpendicularly cross at the center of the effective surface, and diagonal axes which pass through the center;

the apertures being arranged to constitute a plurality of vertical rows of apertures which extend in the direction of the vertical axis and are arranged in the direction of the horizontal axis at a predetermined pitch, each of the vertical rows of apertures including a plurality of apertures which are arranged in the direction of the vertical axis with a bridge portion being interposed between two adjacent apertures, and the width of the apertures in the direction of the horizontal axis being formed so as to gradually increase from that of the aperture located at the center of the effective surface to that of the apertures located at the peripheries of the effective surface in the direction of the horizontal axis thereof; and the apertures being formed in a size which is expressed by:

$$W=C+K1\cdot X^2+K2\cdot X^A$$

where W represents the width of the aperture in an arbitrary position on the effective surface in the direction of the horizontal axis; C represents the width of the aperture at the center of the effective surface; X and Y represent coordinates of the aperture at the arbitrary position relative to the horizontal axis and vertical axis; and K1 and K2 are coefficients.

7. A color cathode ray tube according to claim 6, wherein the width of the apertures in the direction of the horizontal axis is formed so as to gradually increase from that of the aperture located in the center of the effective surface to that of the apertures located at the peripheries in the direction of the vertical axis.

* * * * *